United States Patent [19]

Foa

[11] Patent Number: 4,865,518

[45] Date of Patent: Sep. 12, 1989

[54] FLOW INDUCTION DEVICE

[76] Inventor: Joseph V. Foa, 3404 Thornapple St., Chevy Chase, Md. 20815

[21] Appl. No.: 252,518

[22] Filed: Sep. 30, 1988

[51] Int. Cl.[4] ..... F04F 5/00

[52] U.S. Cl. ..... 417/54; 417/151; 417/198

[58] Field of Search ..... 417/65, 151, 196, 198; 137/624.17, 625.47; 60/201, 39.49, 39.5; 239/457, 460, 568

[56] References Cited

U.S. PATENT DOCUMENTS

| | | | |
|---|---|---|---|
| 1,192,855 | 8/1916 | Buss | 417/78 |
| 3,046,732 | 7/1962 | Foa | 60/269 |
| 4,239,155 | 12/1980 | Foa | 417/187 X |

OTHER PUBLICATIONS

*Cryptosteady Modes of Direct Fluid–Fluid Energy Exchange,* J. V. Foa and C. A. Garris, 1984, published by A.S.M.F.

*Primary Examiner*—Carlton R. Croyle
*Assistant Examiner*—Robert N. Blackmon

[57] ABSTRACT

This invention relates to ejector pumps, thrust- and lift-augmenting ejectors, and, more generally, to devices that are capable of inducing the flow of a fluid through direct transfer of energy and momentum to it from jets of another fluid. The efficiency of the energy exchange is increased if it is made to take place, at least in part, through the nondissipative work of interface pressure forces. This invention describes a method and apparatus for the generation, control, and utilization of this nondissipative component. The method described here imparts a transverse, paddle-like motion to the energizing jets without, however, imparting the same motion to the fluid particles that make up the jets themselves, hence at no cost in energy input. Energy is transferred from these "fluid paddles" to the surrounding fluid largely through the work of interface pressure forces.

3 Claims, 1 Drawing Sheet

FLOW INDUCTION DEVICE

BACKGROUND OF THE INVENTION

This invention relates to a method and apparatus for improving the performance of pumping and thrust- or lift-augmenting ejectors, and, in general, of devices in which a fluid is induced to flow through direct exchanges of momentum and energy with another flow.

Direct flow induction—the direct transfer of momentum and energy from one fluid stream to another—generally involves both a dissipative and a non dissipative component, the latter being provided by the work of interface pressure forces. For these forces to do work, the interfaces on which they act must be allowed or imparted a transverse motion. Therefore, the nondissipative component of energy transfer can take place only where the interacting flows are nonsteady. It does not follow, however, that the nonsteady modes of flow induction are always to be preferred to the steady ones. In the first place, interface pressure forces may act in a direction to oppose, rather than to promote, the desired transfer of momentum and/or energy; and in the second place, the flow losses associated with the generation of the required nonsteadiness are often large—large enough, in some cases, to outweigh whatever benefit could otherwise be derived from the subsequent utilization of the nonsteadiness so generated.

A notable exception in this respect is the class of those mechanisms which transform a steady-flow interaction into a nonsteady one by the simple artifice of utilizing it in a frame of reference other that the unique one in which it is steady. Flow induction mechanisms of this class are exemplified by the rotary jet (U.S. Pat. No. 3,046,732), which is an ejector in which the driving ("primary") jets are made to issue out of slanted nozzles on the periphery of a free-spinning rotor. The rotor, and with it the interfaces between the primary jets and the surrounding ("secondary") fluid, are thus made to rotate, thereby allowing the interface pressure forces to do work. Theory predicts, and experiments have confirmed, a consistently and significantly higher energy transfer efficiency for the rotary-jet ejector, all else being equal, than for its steady-flow counterpart.

An important drawback of the rotary jet relative to the conventional steady-flow ejector is its poor adaptability to axially symmetric interaction spaces. Filling such spaces with clusters of rotary jets could not fully solve the problem of space utilization and may well entail adverse interference effects. A far more promising approach is offered by the concept discussed in the following paragraphs.

SUMMARY OF THE INVENTION

This invention describes a method and apparatus for the generation, control, and utilization of the work of interface pressure forces in the direct transfer of energy and momentum from one flow to another within interaction spaces of almost any desired cross-sectional shape. This is accomplished by causing the source or sources of the energizing ("primary") jets to move transversely in accordance with preselected time-position schedules, without, however, imparting the same motion to the fluid particles that make up the jets themselves, hence at no cost in energy input.

BRIEF DESCRIPTION OF THE DRAWINGS

The invention will be described hereinunder with reference to the accompanying drawings, in which.

DESCRIPTION OF THE PREFERRED EMBODIMENTS

Figure 1:
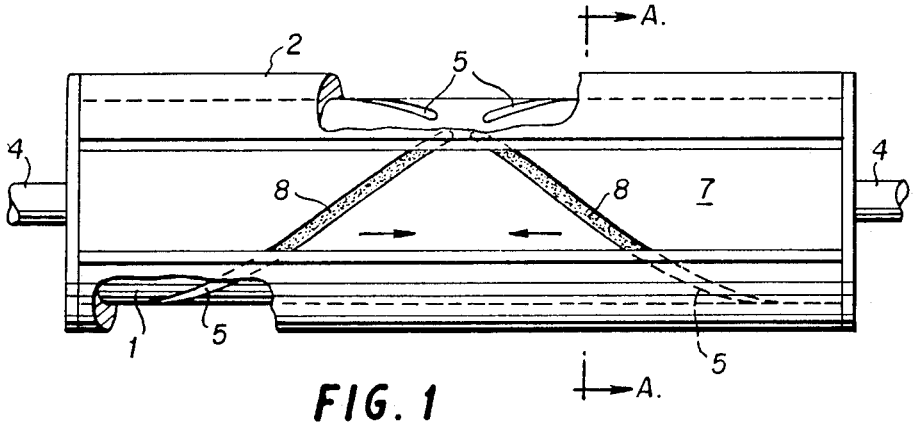
FIG. 1 is a side view of an embodiment of the invention.
Figure 1A:
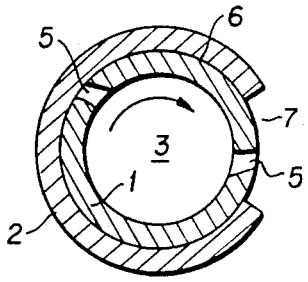
FIG. 1*a* is a sectional view of the same apparatus.

FIGS. 1 and 1*a* describe, for the purpose of illustration, a device operating on the basis of this mechanism. The device comprises a rotor 1 and a casing 2. The interior 3 of the rotor is adapted to receive from an external source, through pipes 4, a primary fluid under pressure, and communicates with the rotor's exterior through slots 5, which are cut through the rotor's wall along helical or other patterns generally skewed to the rotor's axis of rotation. The inner surface 6 of the casing encloses the peripheral surface of the rotor except over a limited sector within which the casing opens, through a longitudinal aperture 7, to the space into which the primary flow is discharged to induce the flow of a secondary fluid. If the clearance between surface 6 and the peripheral surface of the rotor is small enough, at least alongside slots 5 and/or aperture 7, to effectively prevent leakage therebetween, the primary fluid will effectively be discharged into the interaction space only through the areas 8 where slots of set 5 open to aperture 7. The position of each of these areas changes when the angular position of the rotor relative to the casing is changed. Thus, the issuing jets are imparted a transverse, paddle-like motion (as indicated by the arrows in FIG. 1) when the rotor spins. A variety of jet actions and interactions can be achieved through appropriate positioning and design of apertures and slots. The rotation of the rotor can be produced by an externally-applied torque or, more simply, by the reaction of the issuing jets themselves, as is the case with the rotor shown in FIG. 1a, where the discharge passages are shaped to deflect the primary flow to a non-radial orientation relative to the rotor. Under these conditions the rotor, if fully free-spinning, will be driven by the issuing jets to spin at such an angular velocity that the angular momentum of the primary particles will be the same at the exit from the rotor as at the entrance thereto.

It should be noted that, whereas each jet in the process just described is imparted a transverse motion, the fluid particles which make up the jet itself are not made to partake of this motion. By virtue of this fact, the transverse motion of the jet is obtained at no energy cost except for the cost of frictional losses; and even such interactions as the head-on collision of two jets moving at high speed in opposite directions along the same path (such as the collision that is about to take place in the situation depicted in FIG. 1) turn out to be, in this process, essentially nondissipative.

The action of the fluid paddles so formed has two effects: one is to improve the efficiency of energy transfer through utilization of the work of interface pressure forces, and the other is to promote mixing, thereby further reducing the length of the required interaction space.

Figure 2:
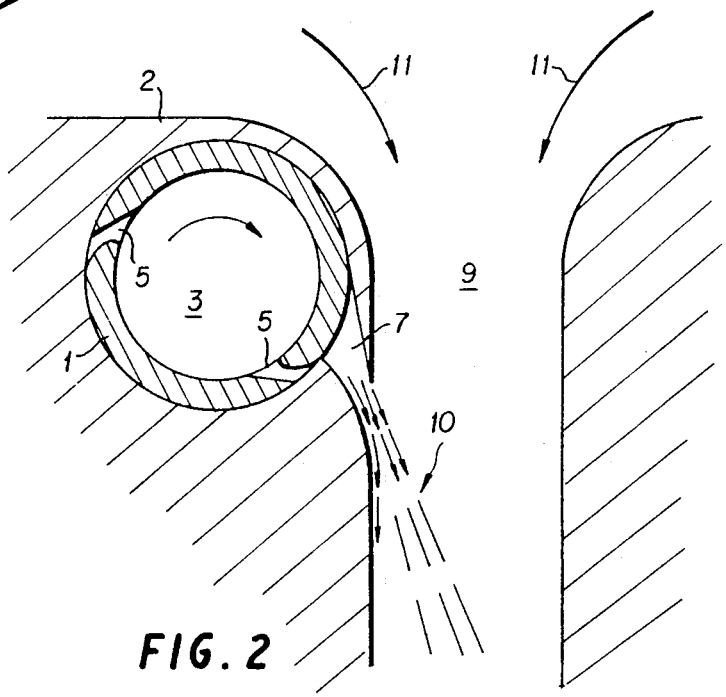
FIG. 2 is a sectional view of the integration of an embodiment of the invention into a flow induction system.

FIG. 2 shows a possible flow induction arrangement operating on the basis of the mechanism just described.

In this figure, 9 is the interaction space, 10 the primary jet, and 11 the induced secondary flow, while the other numbers refer to the same components as in FIGS. 1 and 1a. The transverse motion of the jets in this arrangement is normal to the direction of the secondary flow; in other arrangements it may be parallel or otherwise oriented relative to it, or its orientation may vary from point to point along its path. In any case, the described mechanism can readily be adapted for use in any of the many arrangements that have been suggested for use in steady-flow induction devices.

What is claimed is:

1. The method of imparting a transverse motion to a fluid jet being discharged out of a first space into a second space without imparting the same motion to the fluid particles within said jet itself, comprising separating said first space from said second space by means of a partition consisting of a first wall facing said first space and a second wall, parallel and proximate to said first wall, facing said second space, said first wall being traversed by a first set of slots and said second wall being traversed by a second set of slots, the orientations of the slots of said first set along said first wall being generally different from the orientations of the slots of said second set along said second wall, keeping the two walls, at least alongside the slots of one of the two sets, in effectively sealing proximity to one another, thereby limiting the discharge of said fluid from said first space into said second space to those areas where slots of said first set open to slots of said second set, and moving said first wall relative to said second wall in a direction generally at an angle to the orientation of the slots of both sets, thereby causing the jet discharge areas to move along the slots of said second set.

2. A flow induction device in which energy is transferred directly from a flow of a primary fluid to a flow of a secondary fluid through the work of pressure forces acting on transversely moving interfaces between the two flows, independently of mixing, diffusion, and heat transfer therebetween, comprising: a rotatably-mounted hollow rotor; means for supplying a primary fluid under pressure to the interior of said rotor; one or more wall slots through which said primary fluid may be discharged out of said rotor, the orientation of said slots on the surface of said rotor being generally skewed to said rotor's axis of rotation; a stationary casing, whose inner surface encloses the external surface of said rotor but opens, through one or more apertures within one or more sectors of its periphery, to an interaction space adapted to receive also said secondary fluid, said two surfaces being in effectively sealing proximity to one another at least alongside said slots and/or said apertures, the skew angles of said slots being generally different, at any axial location, from the skew angles of said apertures, whereby the discharge of said primary fluid from said rotor into said interaction space takes place through those areas where slots in said rotor open to apertures in said casing; and means for rotating said rotor relative to said casing, thereby causing said discharge areas to move transversely along said apertures and allowing momentum and energy to be transferred from said primary to said secondary fluid through the work of said interface pressure forces.

3. A flow induction device as set forth in claim 2, in which the last-mentioned means includes means for so deflecting the flow of said primary fluid within said rotor as to impart to the jets issuing therefrom a tangential component of velocity relative to said rotor, thereby causing said rotor to be wholly or partially driven by the reaction of said issuing jets themselves.

* * * * *